US006012872A

United States Patent [19]

Perry et al.

[11] Patent Number: 6,012,872

[45] Date of Patent: Jan. 11, 2000

[54] FLOOD CONTROL SYSTEM

[75] Inventors: James D. Perry, Humble; Stephen E. Benet, Friendswood, both of Tex.

[73] Assignee: Tobor & Goldstein, L.L.P., Houston, Tex.

[21] Appl. No.: 09/006,470

[22] Filed: Jan. 13, 1998

[51] Int. Cl.[7] ..... E02B 3/12

[52] U.S. Cl. ..... 405/114; 405/111; 405/20; 220/1.6; 220/495.05; 220/495.06; 220/646

[58] Field of Search ..... 405/20, 70, 71, 405/121, 108–111, 114–115, 110, 16, 17, 107; 220/1.6, 495.05, 495.06, 62.11, 608, 623, 669–673, 62.18, 645, 646

[56] References Cited

U.S. PATENT DOCUMENTS

| | | | |
|---|---|---|---|
| 422,901 | 3/1890 | Arnett | 405/114 |
| 848,319 | 3/1907 | Phillips | 220/62.18 X |
| 1,077,791 | 11/1913 | Blaauw . | |
| 3,191,386 | 6/1965 | Wiegel et al. . | |
| 3,213,628 | 10/1965 | Serota . | |
| 3,901,406 | 8/1975 | Kivett | 220/8 |
| 4,362,433 | 12/1982 | Wagner et al. . | |
| 4,370,075 | 1/1983 | Scales | 405/20 |
| 4,692,060 | 9/1987 | Jackson, III . | |
| 4,869,617 | 9/1989 | Chiodo | 404/6 |
| 4,921,373 | 5/1990 | Coffey . | |
| 5,040,919 | 8/1991 | Hendrix . | |
| 5,059,065 | 10/1991 | Doolaege . | |
| 5,125,767 | 6/1992 | Doolaege . | |
| 5,154,302 | 10/1992 | Alcorn | 220/4.16 |
| 5,183,180 | 2/1993 | Hawkins et al. | 220/669 X |
| 5,188,460 | 2/1993 | Dorse | 220/495.06 X |
| 5,632,573 | 5/1997 | Baker . | |
| 5,645,373 | 7/1997 | Jenkins . | |
| 5,655,679 | 8/1997 | Schutz | 220/1.6 |
| 5,673,664 | 10/1997 | Lassanske | 220/495.05 X |
| 5,779,391 | 7/1998 | Knight | 405/20 |

*Primary Examiner*—William Neuder
*Assistant Examiner*—Sunil Singh
*Attorney, Agent, or Firm*—Tobor, Goldstein & Healey, L.L.P.

[57] ABSTRACT

A flood control system, in one aspect involving providing a plurality of substantially rigid containers, at least some of the containers having a top portion, a bottom portion and substantially rigid sidewalls operably connecting the top and bottom portions, the sidewalls being configured to withstand compressive forces between the top portion and the bottom portion; and positioning the plurality of substantially rigid containers at a selected location proximate a body of water, at least some of the substantially rigid containers being positioned at the selected location in a substantially abutting relationship to form a barrier.

17 Claims, 5 Drawing Sheets

Fig. 12
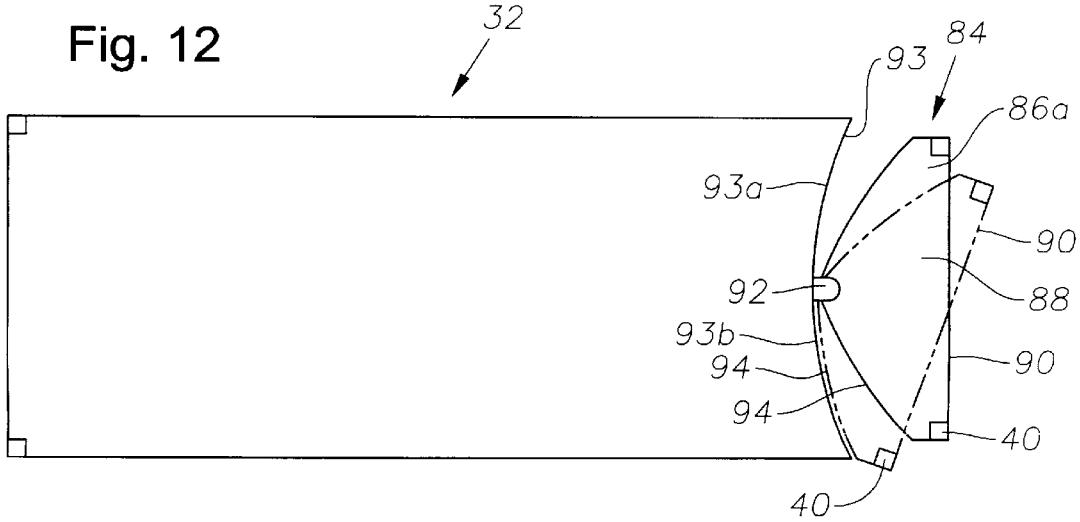
Fig. 13
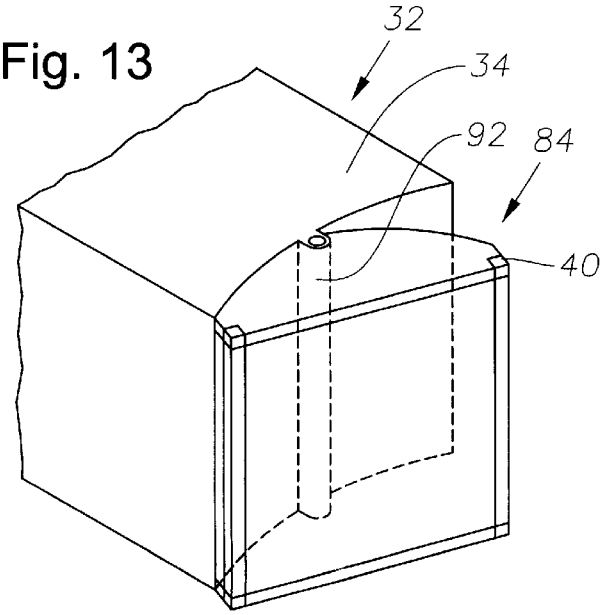
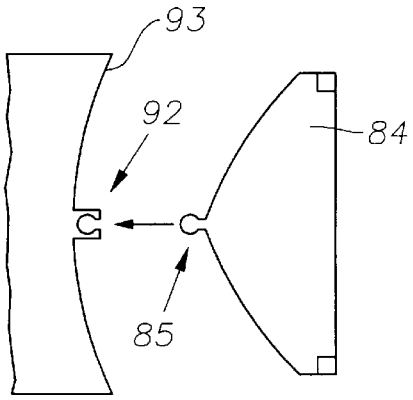
Fig. 14
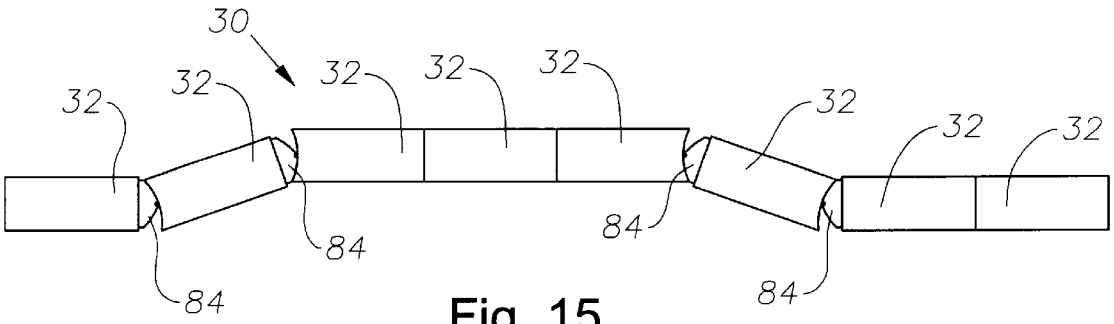
Fig. 15

FLOOD CONTROL SYSTEM

BACKGROUND OF THE INVENTION

1. Field of the Invention

This invention relates broadly to methods for preventing or inhibiting the flow of water and other fluids, including oily water or toxic chemicals. In a preferred aspect, the invention relates to flood control systems, and more preferably to portable flood control systems.

2. Description of the Related Art

In a broad sense, flood control systems may be classified as either stationary or portable. One common type of stationary flood control system is a fixed, concrete dam. An early effort at improving stationary dams is disclosed in U.S. Pat. No. 1,077,791, disclosing a concrete dam structure having a "honeycomb" construction, with individual cells that may be either empty or filled with water.

For portable flood control, the most well-known and widely used technique is still conventional sandbags. During flooding, sandbags are typically placed by human hands at locations that are still above the rising water level, to collectively create a wall, dam, or barrier against the flood waters. Sandbags, however, have a number of problems. One of the problems with sandbags lies in the amount of human labor required for their installation. Each bag must be filled, usually by hand, then placed at the location where the barrier is being constructed. Another problem is the need for sufficient quantities of sand for filling purposes. It is of course preferred that the sand be close to the location where the barrier or dam is being constructed. When that is not the case, the necessary quantities of sand must be transported, which is expensive and time-consuming. Yet another problem is the logistics of coordinating the human effort of transporting the sand, filling the bags and placing the bags at the right location within the appropriate time frame. The sheer number of sandbags often makes this a Herculean task, which is exacerbated by the fact that it is often done in pouring rain. Still another problem is that after flooding, once the waters have subsided, the sandbags must be removed, either in a filled condition, or else emptied of their contents at the location. Consequently, other approaches have been suggested as a substitute for sandbags. For the most part, however, as far as the inventors know, these systems have not been used commercially, at least not to any appreciable extent.

Many of these systems simply rely on water or fluid (instead of sand) placed inside tubes or other structures to provide the weight needed to resist the hydrostatic forces of rising water. Such systems are exemplified in the "Water-Bag Dam or Dike and Method," disclosed in Jackson III, U.S. Pat. No. 4,692,060; in the "Barrier for Containing Floods," disclosed in Coffey, U.S. Pat. No. 4,921,373; in the "Wall-Like Retainer Segments for Retaining Fluids," disclosed in Baker, U.S. Pat. No. 5,632,5723; in the "Device for Controlling Flood Waters and/or Hazardous Liquid Spills," disclosed in Hendrix, U.S. Pat. No. 5,040,919; and in the "Apparatus and a Method for Joining Water Structure Sections or the Like," disclosed in Doolaege, U.S. Pat. No. 5,059,065. Some systems are rather complex. For example in Jenkins, U.S. Pat. No. 5,645,373, the "Flood Control Barrier System and Method" involves a complicated system of elongated, inflatable tubular ballast members. At least one of the shortcomings of the above systems is that they are difficult to install quickly. Further, they are incapable of providing resistance to flood waters unless they are filled with water.

Some systems rely on the use of individual "water bags" or other plastic, flexible water-filled articles of various sizes. These water bags serve essentially as replacements for sandbags. These are exemplified by the "Flood Disaster Control Bag," in Wagner et al., U.S. Pat. No. 4,362,433; the "Water Filled Plastic Dam Structure," in Serota, U.S. Pat. No. 3,213,628; the "Hovering Bag Breakwater," in Weigel et al., U.S. Pat. No. 3,191,386; and the "Method and Apparatus for Constructing Hydraulic Dams and the Like," in U.S. Pat. No. 5,125,767. Among the many shortcomings of these "water bag" approaches is that many of them simply do not adequately overcome the time and labor problems presented by sandbags. For example, the water bags or containers in Wagner '433 and Serota '628 must be filled with water before they can provide an effective barrier to flood waters. The plastic container in Serota '628 must be filled with water even before it is positioned, since without water, in its collapsed state, it is essentially formless. Unless these containers are filled with water, they cannot be stacked nor can they even form an effective barrier.

Accordingly, as discussed in greater detail below, the present invention provides a much improved approach to flood control, overcoming one or more of the above shortcomings of earlier systems.

SUMMARY OF INVENTION

In a broad aspect, the invention is directed to a flood control method and apparatus. In a specific aspect, the method involves: (a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion; and (b) positioning the plurality of substantially rigid containers at a selected location proximate a body of water, at least some of the substantially rigid containers being positioned at the selected location in a substantially abutting relationship, to form a barrier. Preferably, as discussed in greater detail below, the sidewalls are partially or totally corrugated.

In a more specific aspect, the flood control method includes the steps of: (a) locating a flood zone prior to flooding, the flood zone being proximate a body of water having a top surface, the body of water being susceptible to flooding whereby the top surface of the body of water rises and the water flows into, and onto, the flood zone; (b) locating a barrier zone proximate the flood zone; (c) providing a substantially level support surface within the barrier zone; (d) providing a plurality of substantially rigid containers, some of the substantially rigid containers having upper and lower portions, with substantially rigid sidewalls operably connecting the upper and lower portions; (e) providing a plurality of anchoring members for at least some of the substantially rigid containers; (f) positioning at least some of the substantially rigid containers in a substantially empty state adjacent to one another in a substantially abutting relationship on the substantially level support surface within the barrier zone to form a barrier to flooding; (g) attaching at least some of the substantially rigid containers to the anchoring members; (h) attaching at least one of the substantially rigid containers to an adjacent substantially rigid container; and (I) forming a seal between adjacent substantially rigid containers to prevent the flow of water between the adjacent substantially rigid containers.

In another aspect of the invention, the flood control method includes the steps of: (a) providing a first container and a flexible sheet, the first container having at least a top portion, a bottom portion, and four sidewalls, the flexible sheet being substantially impervious to water, and having at least one fixed edge, which is connected to the first container, and at least one free edge, which is unconnected to the first container; (b) placing the first container adjacent a second container proximate a body of water that is susceptible to flooding by a rising water level, to form a barrier against the flooding, wherein a ground surface is located between the housing and the body of water; and (c) disposing at least a portion of the free edge of the flexible sheet over at least a portion of the ground surface between the body of water and the barrier formed by the first and second containers.

Another aspect of the invention relates to a flood control apparatus, which preferably includes: (a) at least two adjacent, substantially rigid containers in a substantially abutting relationship, each of the at least two containers having a top portion, a bottom portion and substantially rigid sidewalls operably connecting the top and bottom portions, the substantially rigid sidewalls being configured to withstand compressive forces between the top portion and the bottom portion, the top and bottom portions and the substantially rigid sidewalls defining a receptacle for receiving variable amounts of water; and (b) some form of sealing means for preventing floodwater from passing between the substantially rigid containers.

In still another specific embodiment, the flood control apparatus includes a plurality of substantially rigid containers, each of the substantially rigid containers including at least a first movable steel housing which is constructed of steel and which is capable of being moved from location to location, of being anchored to the ground in a selected location, and of being attached to a second, adjacent movable steel housing by one or more fasteners, the first housing having a top portion and a bottom portion, the housing also having at least one reinforcing sidewall made of steel and operably connecting the top and bottom portions, the steel reinforcing sidewall having a corrugated cross-section comprising portions having varying thicknesses, the reinforcing sidewall providing for the effective transmission of compressive forces between the top portion and the bottom portion, wherein the plurality of substantially rigid containers are positioned in a selected location on a substantially horizontal surface in or proximate a flood zone, the substantially rigid containers being placed end-to-end to form a barrier, the plurality of substantially rigid containers being positioned above the water level of the body of water.

In yet another specific embodiment, a flood control apparatus of this invention includes (a) a substantially rigid container having a top portion, a bottom portion and substantially rigid sidewalls operably connecting the top and bottom portions, the substantially rigid sidewalls being configured to withstand compressive forces between the top portion and the bottom portion; and (b) a flexible container disposed inside the substantially rigid container, the flexible container having an opening for introducing water into the flexible container.

Another specific embodiment of the apparatus, which is preferred, particularly where the contours of the flooding zone are uneven, or where there are natural obstacles proximate the body of water such as trees and the like, is a flood control apparatus that includes: (a) a housing with a top portion, a bottom portion and sidewalls; (b) a swiveling end section adjacent to one of the sidewalls, the swiveling end section having a substantially flat outer surface; and (c) a hinge operably connecting the swiveling end section to the housing.

The substantially rigid sidewalls may include one or more substantially vertically disposed integral vertical reinforcing structures for providing resistance to the compressive forces between the top and bottom portions of the housing. In connection with the flood control method, the substantially rigid sidewalls may also include non-integral members for providing resistance to compressive forces between the top and bottom portions of the housing. These non-integral members may be used instead of, or in addition to, the integral reinforcing members.

Preferably, in connection with the flood control method and apparatus provided herein, the substantially rigid sidewalls are capable of withstanding at least about 20,000 pounds of compressive force. As discussed below, it is more preferable that the substantially rigid sidewalls provide even more reinforcement and support to the substantially rigid container, such that the sidewalls are capable of withstanding over 40,000 pounds of compressive force, and, more preferably, over 80,000 pounds of compressive force.

A specific embodiment of this invention, which is preferred, is to provide a substantially rigid container that is transportable and includes a housing constructed of steel, the housing being capable of being moved from location to location, of being anchored to the ground in a selected location, and of being attached to a second, adjacent steel housing by one or more fasteners. The housing having a top portion and a bottom portion, the housing also having at least one reinforcing sidewall made of steel and operably connecting the top and bottom portions, the steel reinforcing sidewall having a corrugated cross-section.

The flood control method can also include the step of adding a sufficient volume of water to the inside of at least one of the substantially rigid containers to provide sufficient weight to the substantially rigid containers to withstand flood water acting against at least one of the sidewalls.

Further, the flood control method should include the step of inserting a flexible container into at least one of the substantially rigid containers, then adding water to the inside of the flexible container. As will be discussed in greater detail below, these flexible containers should be large bladders made of a material such as plastic, with an opening to receive water. In using the flexible container with the flood control method, it is preferred to also provide for removing the water from the flexible container, e.g., after flooding and prior to removing the substantially rigid containers from a barrier zone.

In a preferred aspect, the method also includes the step of connecting one or more of the plurality of substantially rigid containers to another container. Further, where at least two of the substantially rigid containers are adjacent to one another, such that a gap forms between them, the method also may additionally include the step of sealing the gap to prevent water from flowing between the adjacent substantially rigid containers. In one embodiment, this step of sealing the gap includes applying a curable foam to the gap. In another specific embodiment, the step of sealing the gap includes applying a plastic sheet over the gap.

Preferably, the flood control method also includes the step of anchoring at least one of the substantially rigid containers to a fixed object. In addition, the method should also include the step of stacking at least one of the substantially rigid containers on top of another substantially rigid container.

Further, wherein a plastic sheet is connected to the housing, and an air space is formed between the first and second substantially rigid containers, it is preferred that at least a portion of the free edge of the flexible sheet covers the air space.

Where a flexible sheet is used as part of the flood control method, at least a portion of the free edge of the flexible sheet may be weighted. Preferable, the weighted portion of the flexible sheet includes a metal bar.

In addition, where a flexible sheet is used, it is preferred that at least a portion of the flexible sheet attached to one substantially rigid container overlaps at least a portion of another substantially rigid container.

The rigid containers may have various structures. In one specific embodiment, at least one of the sidewalls of the substantially rigid outer container is partially open. In contrast, in another specific embodiment, at least one of the sidewalls of the substantially rigid outer container is completely closed.

BRIEF DESCRIPTION OF DRAWINGS

FIG. 12 is a top view of a container with a swiveling end section.

FIG. 13 is a perspective view of the container and swiveling end section shown in FIG. 12.

FIG. 14 is a cut-away side view of the end of a container with a "ball-and-socket" swiveling end.

FIG. 15 is a top view of a plurality of containers forming a barrier to flooding, where some of the containers have swiveling end sections.

DETAILED DESCRIPTION AND SPECIFIC EMBODIMENTS

As mentioned above, the invention is preferably directed to flood control systems. Both methods and apparatus for flood control are within the scope of the invention. We will now describe specific embodiments, examples and versions of the invention, for the purpose of enabling others skilled in the art to make and use our invention. It is understood, however, that the invention is not limited to these specific embodiments, examples and versions. Nor is the invention restricted to flood control as such, but may be used in other applications involving the forming of a barrier to prevent or restrict the flow of any liquid. A person skilled in the art who has read this patent or seen the invention being used, described, or implemented will recognize many variations of the invention that might not be expressed here. Thus, it is the claims below that should be referred to for purposes of determining the scope of the invention, not only the literal elements therein, but also their substantial equivalents, including elements known to be interchangeable.

Figure 1:
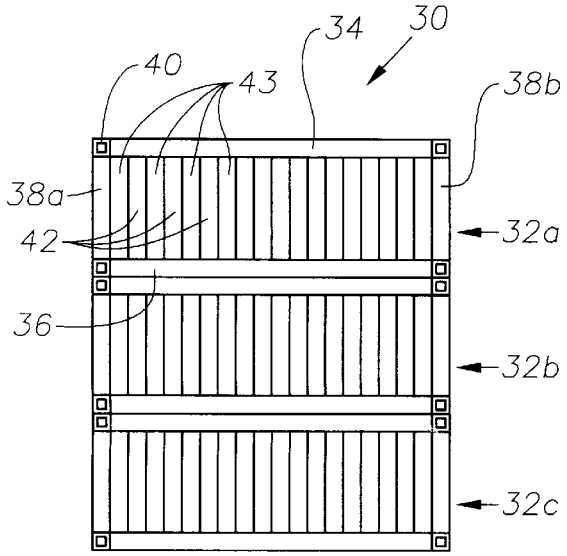
FIG. 1 is a front view of three substantially rigid containers with corrugated sidewalls, stacked on top of one another, positioned for flood control.
Figure 2:
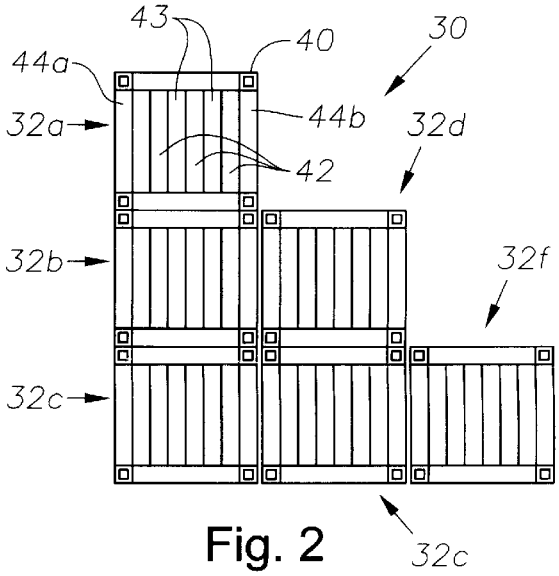
FIG. 2 is a side view of six substantially rigid containers.

FIG. 1 is a front view of a flood control system, as viewed from the body of water that is susceptible to flooding, e.g., a river or lake. FIG. 2 is a side view of the same flood control system. In the particular embodiment shown in FIGS. 1 and 2, the barrier 30 is composed of six individual substantially rigid containers 32*a,* 32*b,* 32*c,* 32*d,* 32*e,* 32*f.* (These will be referred to collectively as "containers," using the single reference number 32.) As shown in FIG. 1, the first row of containers 32*a,* 32*b* and 32*c* are stacked on top of one another. The second row of containers 32*d* and 32*e* are stacked behind the first row of containers, on the other side from the body of water, and cannot be seen in FIG. 1, but can be seen in FIG. 2. The last row of containers is a single container 32*f,* also shown in FIG. 2. Naturally, the barrier of the invention may include any combination or configuration of containers. As will be discussed below, the design and reinforced construction of the containers 32 provide for the ability to stack the containers as shown in FIGS. 1 and 2.

Preferably, each container has corrugated sidewalls. Moreover, they can be stacked empty, then filled with selective amounts of water.

As seen in FIG. 1, each container 32 has a top portion 34, a bottom portion 36 and reinforced sidewalls. Broadly, the term "sidewalls" as used herein refers to the walls or other portions of the container (usually vertical sides) that transmit or withstand compressive forces from or between the top and bottom portions 34, 36. The sidewalls will typically, but not necessarily, be substantially vertical, as shown in the drawings herein. In the specific embodiment shown in FIGS. 1 and 2, the sidewalls include two planar end members 38*a,* 38*b,* parallel with one another, and on opposite ends, and two planar side members, 44*a,* 44*b,* also parallel with one another and on opposite sides. Of course, the number of members may vary. For example, if the containers are triangular, having three planar members as sidewalls, they would not be parallel. Also, at least one of the sidewalls may be curved.

At least two, and preferably all, of the sidewalls are "substantially rigid." The term "substantially rigid" means that some "flex" in the sidewalls can be present, but not so much that the sidewalls collapse or lose their ability to provide support when compressive forces are acting on them. For example, when subjected to compressive forces, it is understood that even metal sidewalls will bend or flex to some degree. However, at the very least, the substantially rigid sidewalls of containers 32 should be capable of withstanding the compressive forces resulting from other objects, e.g., other containers, being stacked on top of them. In contrast, plastic containers such as water bags are typically not substantially rigid. Preferably, all four sidewalls in containers 32 are substantially rigid. In the embodiment shown, the rigidity is provided by the corrugated shape of the sidewalls, where the outermost surfaces 42 and the innermost surfaces 43 provide a corrugated shape to all the sidewalls 38*a,* 38*b,* 44*a,* 44*b.* (See FIG. 7.) Advantageously, this substantial rigidity also provides the sidewalls with the ability to withstand the extremely large forces that are involved with large scale flood control. Preferably, the sidewalls are capable of withstanding at least 10,000 to 20,000 pounds of force, more preferably, at least 50,000 pounds, and most preferably at least 80,000 pounds of force, or even as much as 100,000 pounds of force or more.

Figure 3:
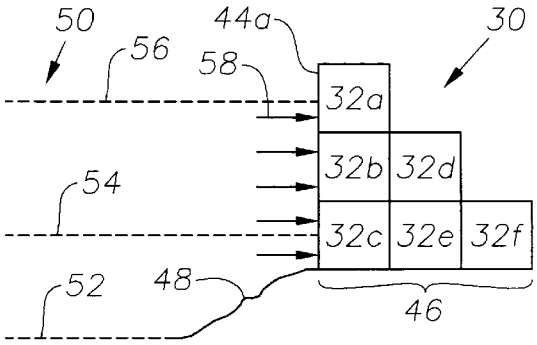
FIG. 3 is a side view of six substantially rigid containers, positioned in a barrier zone proximate a body of water that is susceptible to flooding.

Preferably, each container is of a size and strength sufficient not only to block substantial amounts of floodwater by itself, i.e., having a side facing the flooding with a sufficiently large surface area to block water, but also to support one or more other containers stacked on top, as illustrated in FIGS. 1, 2 and 3. Containers designed for shipping can be modified or used in accordance with this invention for flood control purposes. For example, corrugated metal containers that are about 20 feet long, 8.5 feet high and 8 feet wide are available from TransAmerica, Inc. and Sea Container, Inc.

Referring now to FIG. 3, a flood barrier is shown in barrier zone 46, which is proximate a body of water 50, but is preferably above the water level of the body of water, and is preferably on dry land at a vertical level or altitude such that it can be positioned before the water level reaches any of the containers. The barrier zone 46 preferably includes a substantially level support surface, which may be prepared beforehand, e.g., by the use of grading equipment. Advantageously, with this invention, however, the level support surface can easily be prepared without harm to the environment, and can made to look aesthetically pleasing, e.g., by planting grass or the like. Furthermore, in accordance with other aspects of this invention, because the containers are preferably positioned in the barrier zone only temporarily at the onset of flooding, they may be later removed. Thus, the barrier zone can be left in the same condition as before the flooding and positioning of the containers.

In FIG. 3, barrier 30 is seen from the side, so that only one "group" of containers 32*a,* 32*b,* 32*c,* 32*d,* 32*e,* 32*f* can be seen. Not shown are other groups of containers, which are preferably placed in substantial abutting relationship next to adjacent container groups. The arrangement of the six substantially rigid containers in FIG. 3 illustrates how the invention can work in flood control. The different surface levels 52, 54, 56, each corresponds to a different stage of flooding. (Not necessarily drawn to scale.) That is, for example, water level 52 represents the level of the water during normal, non-flooding conditions. Water level 54 represents medium flooding, while water level 56 represents high flooding. As the water level rises, the water applies hydrostatic forces against the front sidewalls 44*a* of the containers. The arrows 58 in FIG. 3 show the hydrostatic forces that are applied against the containers from the rising floodwater. Preferably, the containers have a weight such that, even without being filled with water, they are able to resist or withstand horizontal movement in response to the forces 58 of the water. Not shown but inherent are the compressive forces, which in this case are directed vertically, between the top portion 34 and the bottom portion 36, of each container. It will be appreciated that those compressive forces are much greater in the upper and lower portions of the bottom container 32*c* than in either the middle container 32*b* or the top container 32*a.*

Figure 4:
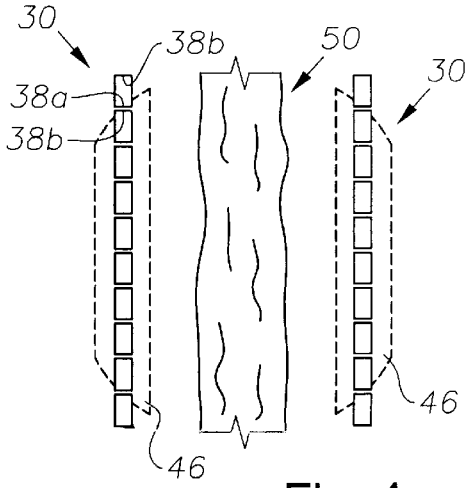
FIG. 4 is a top view of substantially rigid containers being placed in substantially abutting relationship to adjacent containers, forming a barrier to flooding of a river.

In FIG. 4, a top view of a multiple-container barrier is shown, where a number of substantially rigid containers 30 are placed end-to-end, in substantially abutting relationship. Adjacent containers may be in physical contact with one another, e.g., where end 38*a* of one container is in physical contact with end 38*b* of an adjacent container. Also, the containers may be connected to adjacent containers via connectors (as discussed below). Alternatively, adjacent containers may be arranged so that a gap is present between the adjacent containers. However, in accordance with other aspects of the invention, some type of seal, e.g., a flexible sheet or curable foam, may be placed so as to close the gap between the adjacent containers. It is thus understood that the term "substantially abutting" does not require that the containers be in physical contact with one another, but rather merely that the containers are arranged sufficiently close to adjacent containers so as to provide an effective barrier to floodwater. Note that, unlike the barrier 30 in FIGS. 1–3, having groups of containers, the barrier 30 in FIG. 4 has only a single row of containers.

It is contemplated that a single row or level of containers is appropriate in situations where the flooding level is not high, e.g., where flood waters rise to a level of about 2–6 feet above the ground level in the barrier zone, and where a single level or row of containers are about eight feet in height.

As mentioned above, an advantage of using a substantially rigid container with substantially rigid sidewalls is that it obviates the need for being filled with water. The weight of each container is such that the containers can be positioned in the barrier zone when they are substantially empty, i.e. without sufficient water to add undue weight. However, because of the substantially rigid sidewalls, they will support one another, such that they can easily be positioned, stacked and, optionally, attached to adjacent containers. Preferably, each container is a durable, high strength container made of steel.

Figure 5:
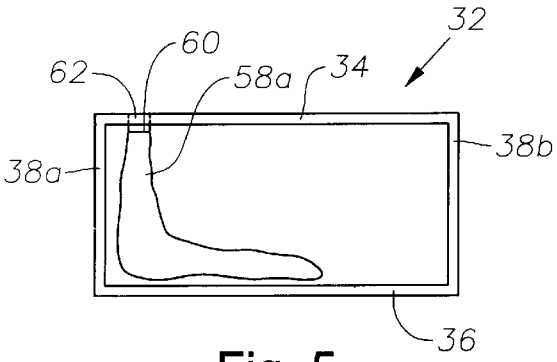
FIG. 5 is a cutaway front view of a substantially rigid container inside of which is an empty flexible container.
Figure 6:
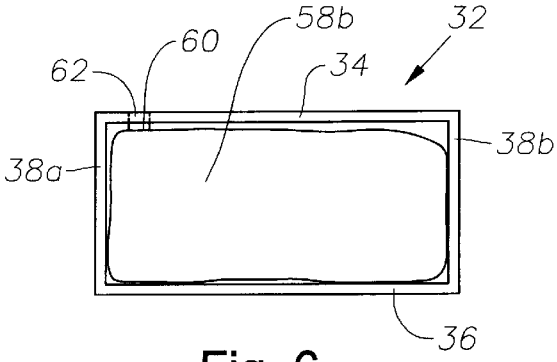
FIG. 6 is a cutaway front view of a substantially rigid container inside of which is a flexible container filled with water.

Referring now to FIGS. 5 and 6, another specific embodiment of the invention is a flood control apparatus that includes a substantially rigid container 32 and at least one flexible container 58, such as a bladder, positioned on the inside of the substantially rigid container. In FIG. 5, the flexible container 58*a* is shown empty, i.e., in an unfilled condition. In FIG. 6, the flexible container 58*b* is shown in a filled condition, e.g., with water. Although the substantially rigid container 32 will typically provide sufficient weight on its own to act as a barrier to flooding, particularly if anchored to the ground or to some fixture, there may be circumstances where it is desirable to add more weight, or at least have the option of adding more weight. Additional weight may be desired in a number of instances. For example, where the floodwaters are not high, so that it is not necessary to stack containers, additional weight may nevertheless be needed where floodwaters create a great deal of horizontal force against the container, e.g., in a fast moving river. Also, additional weight may be needed or desired if for some reason the containers cannot be properly anchored to the ground. Regardless of the reason, the flexible bag or container in the specific embodiment of the apparatus shown in FIGS. 5 and 6 provides for additional weight when filled with water. An opening 60 of the bag receives the water. The rigid container 32 also preferably has an opening or port 62, preferably in the upper portion 34 of the container 32, through which water can be introduced to the flexible container 58.

As briefly mentioned in the summary of this patent, the containers in the apparatus and method of the invention preferably have sidewalls that are partially or totally corrugated. As such, they are capable of withstanding substantial compressive forces directed substantially parallel to the direction of the corrugations, which run substantially vertical when the containers are placed to form a barrier for flood control. Advantageously, the strength and rigidity provided by the corrugations facilitates the stacking of containers on top of one another, and also provides the option of adding water to containers after installation without the danger of collapsing the lowermost containers. The corrugations also have the advantage that thinner sidewalls can be used for the containers, making each container relatively lightweight, which facilitates the mobility, assembling and installation of the flood control apparatus, which is often critical during flooding emergencies. Broadly, the term "corrugated," when used herein, refers to a sidewall or surface of the container, and requires at least that the sidewall or surface be non-flat or uneven, having multiple subsurfaces that lie in more than a single plane. Preferably, each corrugation runs substantially vertically along most of the sidewall, at least between the top and bottom portions of the container. Preferably, also, the "depth" of each corrugation, defined as the distance between the innermost point of each corrugation, e.g., at the inner surface of the sidewall, to the outermost point of each corrugation, e.g., at the outer surface of the sidewall, is sufficient to resist substantial flexing of the sidewall when compressive forces are acting on the sidewall between the top and bottom portions of the container. As shown in the drawings, the individual corrugations of the corrugated surface or sidewall can be (and preferably are) square or rectangular, so that cross-sectional shape of the sidewalls is preferably a series of three-sided squares or rectangles. It is contemplated, however, that other shapes can also be used for the corrugations, e.g., triangular or arc-shaped (not shown). The corrugations can also be enclosed, e.g., formed as hollow tubes between two surfaces or walls.

Figure 7:
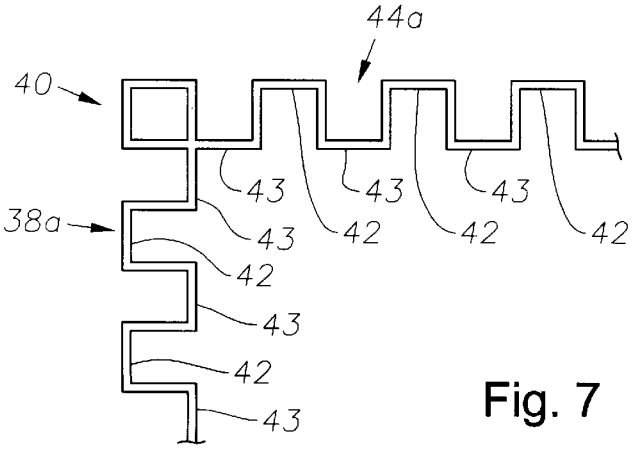
FIG. 7 is a cut-away top view of a comer section of a substantially rigid container showing sidewalls with square-sided corrugations.

The preferred sidewall configuration is shown in FIG. 7 where end member 38*a* and side member 44*a* includes square-shaped corrugations with outermost parts 42 and innermost parts 43.

Figure 8:
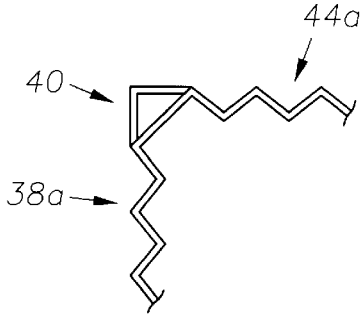
FIG. 8 is a cutaway top view of a comer of a substantially rigid container showing sidewalls with triangular, i.e., pleated or zigzag, corrugations.
Figure 9:
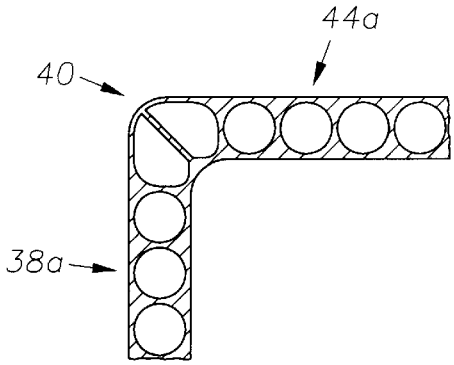
FIG. 9 is a cut-away top view of a corner of a substantially rigid container showing sidewalls with arc-shaped corrugations, specifically, in this embodiment, corrugations forming vertical hollow tubes.

As seen in FIG. 7, the "depth" of each corrugation is the distance between surfaces 42 and 43. The containers shown in FIGS. 1 and 2 have the corrugation configuration of FIG. 7. However, as shown in FIGS. 8 and 9, the corrugations can have different shapes and configurations. In FIG. 8, the corrugations are triangular, so that the sidewall has a pleated or zigzag pattern. In FIG. 9, the corrugations are arc-shaped or circular, and are internal, such that the sidewall includes a series of hollow tubes. It will be appreciated by persons skilled in the art of making flood control devices that a wide variety of other geometries and configurations and dimensions can also be used.

In yet another specific embodiment, the sidewalls can include integral reinforcing members, e.g., the corrugations themselves, which provide strength and substantial rigidity, such that the sidewalls are capable of withstanding compressive forces between the top portion 34 and the bottom portion 36. Certain other specific embodiments of the invention (not shown) have reinforcing members that are not integral with the sidewalls, for example, where the top and bottom portions have lips or edges around their perimeters, and reinforcing bars or other reinforcing members extend from the lips or edges of the bottom portion to those of the top portion. In those embodiments, because the reinforcing members are not integral with the sidewalls, it is contemplated that the sidewalls themselves can be made of a less durable or rigid material, e.g., fiberglass. If the reinforcing members are removable, moreover, the remaining portion of the sidewall can be collapsible, e.g., being made of even a flexible bladder material.

Figure 11:
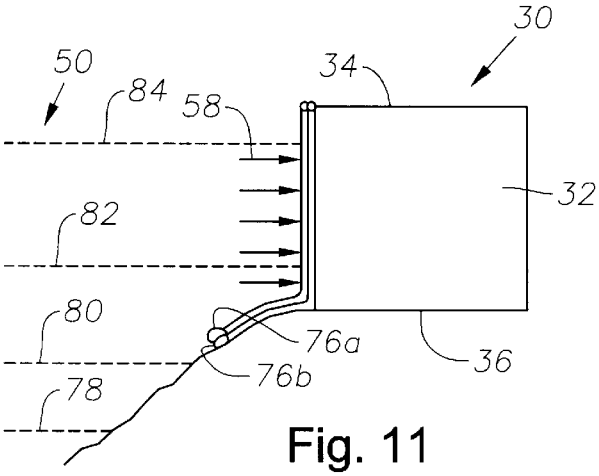
FIG. 11 is a side view of the containers and flexible sheets in FIG. 10.
Figure 10:
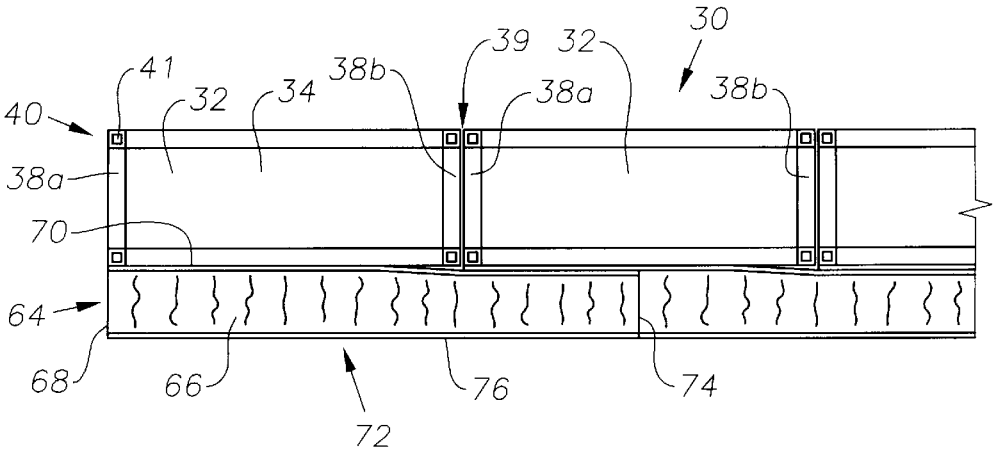
FIG. 10 is a top view of adjacent substantially rigid containers having flexible sheets attached thereto.

FIGS. 10 and 11 show specific embodiments of the invention in which a flood control apparatus includes adjacent substantially rigid containers with flexible sheets attached thereto. As discussed in the summary above, an important feature of a specific embodiment of this invention is the use or inclusion of a seal between adjacent containers 32. The seal 64 can be a curable foam. Examples of curable foams useful for making seals include polyurethane or epoxy-based foams, of the type used in insulation or car seats. Some foams are formed by mixing two components, e.g., a base and a catalytic activator, which react and form a foam when combined. Useful foams are available from AIMS International under the brand name "Foam Kote." Referring to FIG. 10, the foam is injected between surfaces 38*b* and 38*a,* to form a watertight seal 39 between the two adjacent containers 32.

In the specific embodiment in FIG. 10, the seal also includes a flexible sheet. Referring to FIG. 10, the flexible sheet 66 is preferably made of a polymer such as polypropylene, polyethylene, vinyl, or some other durable plastic. Useful sheets are available from G. S. E., Inc. The sheet may also be made of a waterproofed fabric, such as the type of fabrics that are used in making tents. The 29 sheet 66 typically has four edges 68, 70, 72, 74. Edge 70 is connected to the sidewall of the container, or to the top portion 34, or it may also be attached to the edge connecting the sidewall with the top portion. Referring back to FIGS. 10 and 11, the side edges 68 and 74 preferably have sufficient length such that, as seen in FIG. 11, the sheet is capable of "draping" over the ground in front of the container, between the container and the body of water 50. The edge 72 of the sheet 66 is closest to the body of water.

In a preferred embodiment, the sheet 66 includes a metal bar 76, or some other weight, located proximate the lower edge 72 of the sheet 66. The purpose of the bar or weight is to keep the sheet on the ground, and to prevent the sheet from floating when the water level of the body of water 50 rises. As seen in FIG. 10, the length of the sheet 66 is preferably longer than the length of the container, so that it overlaps the sheet of an adjacent container, thus acting as a seal between the two adjacent containers. A side view of this overlap is seen in FIG. 11. As seen by the different water levels 78, 80, 82 84, in FIG. 11, when the flood waters rise, the force of the water pushes against the sheet 66, causing the sheets to be pressed against the containers, and further improving the seal in the gap between adjacent containers 32, e.g., the gap between ends 38*b* and 38*a* of adjacent containers (see FIG. 10). Also, in a preferred embodiment, the sheet is sufficiently wide (along the direction of edges 68, 74) that it is capable of not only draping downward onto the ground in front of the container, but is also sufficiently wide so that, when containers are stacked on top of one another (not shown), the sheet drapes downward, partially covering the sheet of the container below, thus forming a seal on one of the top containers between the top and bottom containers.

Yet another specific embodiment of the invention is shown in FIGS. 12–15, in which the container has a swiveling sidewall, preferably an end section. In FIG. 12, a top view of a container with a swiveling end section is shown, while FIG. 13 is a perspective view of the same container and swiveling end section. FIG. 14 shows a ball-and-socket swiveling end section. FIG. 15 is a top view of a plurality of containers forming a single barrier to flooding, where some of the containers have swiveling end sections. As seen in FIG. 14, at least one advantage of the swiveling end section is that a barrier can be formed along a barrier zone that is irregular in shape. For example, where a river has a bank that has boulders or other obstacles at certain places, a barrier cannot be formed in a straight line. Each swivelling end section can also include clamps (not shown) for holding adjacent containers together.

Referring now to FIGS. 12 and 13, a preferred construction of this specific embodiment is shown. Preferably, a stationary hinge 92 or other support member is affixed to or integral with the container 32, and the swiveling side section 84 turns on the hinge 92. The precise construction of the hinge is not critical; and virtually any type of hinge or means of rotatably attaching the side section 84 may be used. As seen in FIGS. 12 and 13, it is preferred that the end of the container 32 have a concave surface 93, and that the swiveling side section have an inner surface 94, preferably being convex, so that when it is swiveled, the surface 94 abuts surface 93, either surface 93*a* (on one side of the hinge 92) or surface 93*b* (on the other side of the hinge 92). Preferably, the swiveling side section 84 has corner connecters 40, so that the container can be connected to an adjacent container as shown in FIG. 15.

Although the container with the swiveling end-section in FIGS. 12–14 are constructed such that the hinge runs vertically, and the end section swivels back and forth horizontally. The invention also includes a container with a vertically swiveling end section. (Not shown.) Referring to FIG. 14, also included in the scope of the invention is a container with a dish shaped end section, swivellingly connected to the container housing via a member that includes a socket, e.g., a "ball-and-socket" connection.

Figure 16:
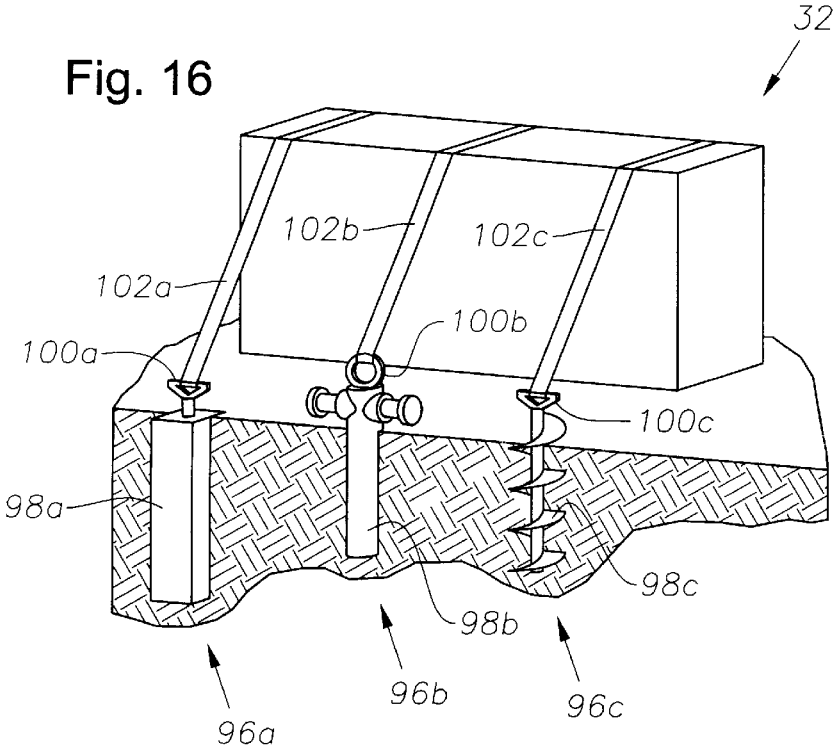
FIG. 16 is a perspective view of a container shown with different anchoring members.
Figure 17:
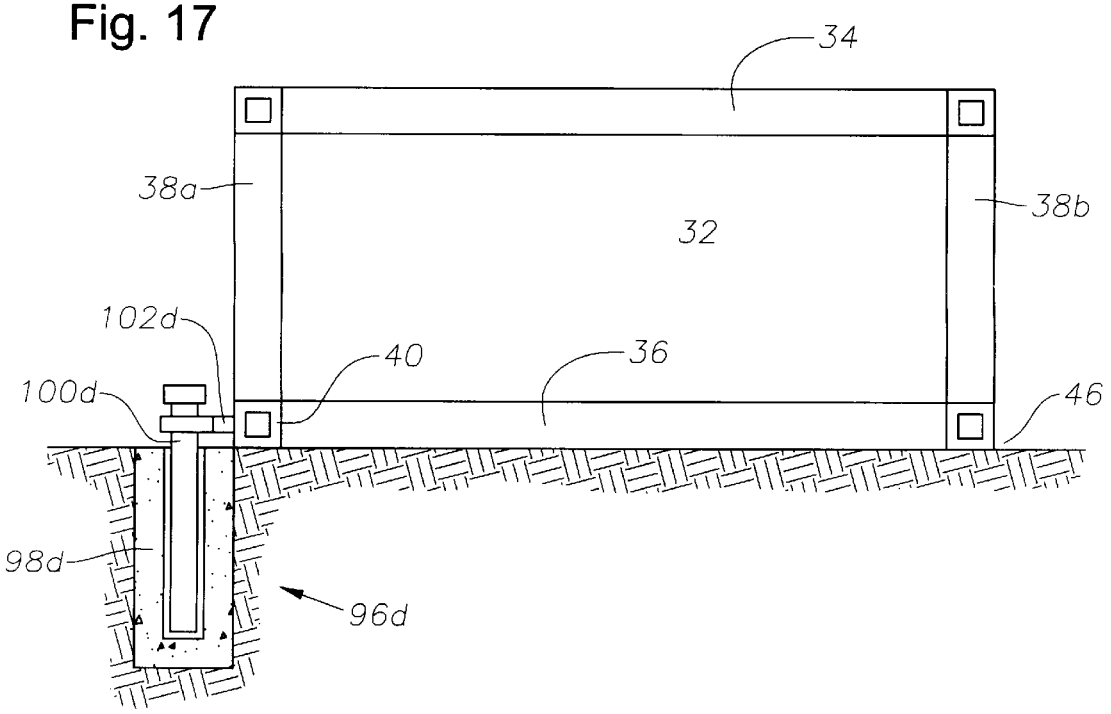
FIG. 17 is a side view of a container with a cutaway section showing another type of anchoring member.

Another feature of the invention, which is part of a preferred embodiment, is an anchor or anchoring member. FIGS. 16 and 17 show various types of anchors. FIG. 16 is a perspective view of a container shown with different anchoring members. (Of course, an actual container should have only a single type of anchor.) The anchors in FIG. 16 are affixed to the container via a strap 102*a*, 102*b*, 102*c*. Not shown are the anchors on the other side of the container. Each anchor 96*a*, 96*b*, 96*c* preferably includes an anchor connector 100*a*, 100*b*, 100*c* and a fixture 98*a*, 98*b*, 98*c*. The fixture affixes the overall anchoring member to the ground. The anchor connector connects the anchor to the container. In anchor 96*a*, the fixture 98*a* is a concrete block; in anchor 96*b*, the fixture 98*b* is a steel pole; while in anchor 96*c*, the fixture 98*c* is an auger-type assembly.

Figure 18:
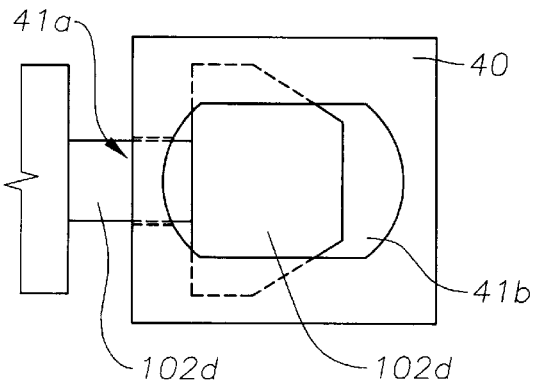
FIG. 18 shows a connector for adjacent containers.
Figure 19:
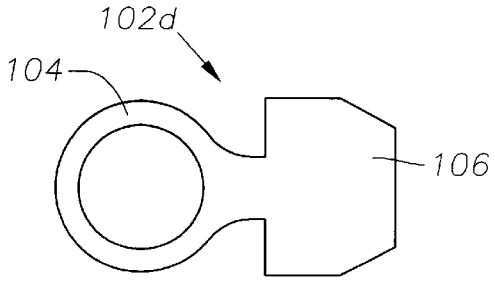
FIG. 19 shows a connector for a container and an anchor.

FIG. 15 is a side view of a container with a cutaway section showing an anchoring member that can be used with the containers discussed above, which may have a comer connector 40, here serving as an anchor connector. The same connecting devices may be used as both anchor connectors and container connectors, i.e., for connecting or attaching adjacent containers. The fixture 98*d* is a concrete block, which can be prepared in advance by pouring concrete in a hole formed in the ground in a barrier zone, where placement of a container is planned. Also formed in the concrete block is a hole, into which a pole or member 100*d* can be removably installed, preferably just prior to positioning of the containers. The anchor connector 102*d* is a conventional "lockable lug nut," which connects the pole portion 100*d* of the anchor to the container. The lockable lug nut is shown in greater detail in FIGS. 18 and 19. In FIG. 19, a top view of a lockable lug nut 102*d* is shown, having a first portion 104 that connects directly to and grips the pole 100*d*, and a second portion 106*e* that fits into the comer connector 40. As seen in FIG. 19, the lug nut fits into the opening 41*a*, so that portion 102*d* fits into the inner portion of the connector, then is twisted so that portion 102*d* is wedged against the inner surface of the connector 40.

Figure 20:
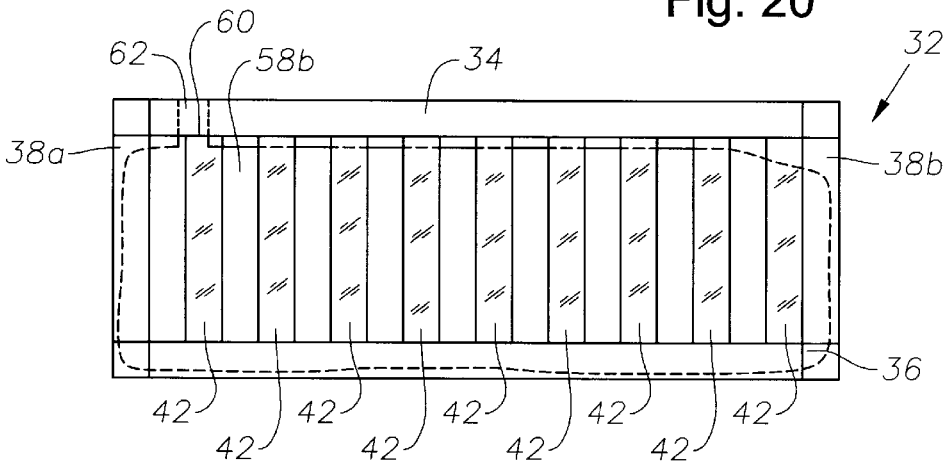
FIG. 20 is a side view of a container with partially open sidewalls and having integral, substantially vertical, reinforcing members.
Figure 21:
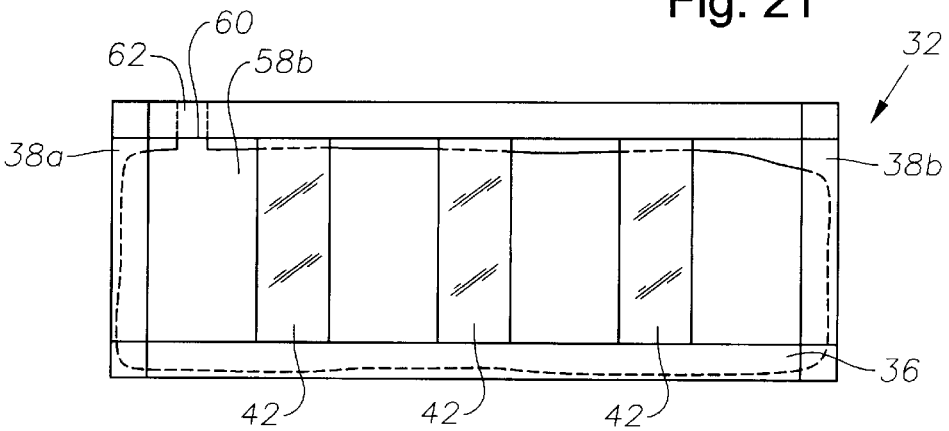
FIG. 21 is a side view of a container, with partially open sidewalls and integral, substantially vertical, reinforcing members.

As mentioned above, various types of substantially rigid containers may be used in accordance with this invention. Preferably, as shown in FIG. 1, the container has integral reinforcing members, as well as closed sidewalls, so that the rigid container can be filled with water, even if it does not have a separate flexible container for water. Although less preferred, another substantially rigid container of this invention has partially open sidewalls, as exemplified in FIGS. 20 and 21, where the sidewalls consist only of integral reinforcing members 42, transmitting forces between the upper portion 34 and bottom portion 36. However, as shown in FIGS. 20 and 21, such an apparatus should also include a flexible container or bladder 58*b* that can be filled with water for added weight as well as to provide the barrier itself in the same manner as the flexible bladder discussed above in connection with FIGS. 5 and 6.

What is claimed is:

1. A flood control method, comprising the steps of:

(a) locating a flood zone prior to flooding, the flood zone being proximate a body of water having a top surface, the body of water being susceptible to flooding whereby the top surface of the body of water rises and the water flows into, and onto, the flood zone;

(b) locating a barrier zone proximate the flood zone;

(c) providing a substantially level support surface within the barrier zone;

(d) providing a plurality of substantially rigid containers, some of the substantially rigid containers having upper and lower portions, with substantially rigid sidewalls operably connecting the upper and lower portions;

(e) providing a plurality of anchoring members for at least some of the substantially rigid containers;

(f) positioning at least some of the substantially rigid containers in a substantially empty state adjacent to one another in a substantially abutting relationship on the substantially level support surface within the barrier zone to form a barrier to flooding;

(g) attaching at least some of the substantially rigid containers to the anchoring members;

(h) attaching at least one of the substantially rigid containers to an adjacent substantially rigid container; and (i) forming a seal between adjacent substantially rigid containers to inhibit the flow of water between the adjacent substantially rigid containers.

2. A flood control method, comprising the steps of:

(a) providing a first container and a flexible sheet, the first container having at least a top portion, a bottom portion, and four sidewalls, the flexible sheet being substantially impervious to water, and having at least one fixed edge, which is connected to the first container, and at least one free edge, which is unconnected to the first container;

(b) placing the first container adjacent a second container proximate a body of water that is susceptible to flooding by a rising water level, to form a barrier against the flooding, wherein a ground surface is located between the first and second containers and the body of water; and (c) disposing at least a portion of the free edge of the flexible sheet over at least a portion of the ground surface between the body of water and the barrier formed by the first and second containers, wherein at least a portion of the flexible sheet overlaps at least a portion of the second substantially rigid container.

3. A flood control method, comprising the steps of:

(a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion, the containers being configured so that they can be stacked thereby forming a stack of containers, the stack of containers being able to withstand compressive forces, and (b) positioning the plurality of substantially rigid containers at a selected location proximate a body of water, at least some of the substantially rigid containers being substantially rigid outer containers, the substantially rigid outer containers being positioned at the selected location in a substantially abutting relationship, to form a barrier, and wherein at least one of the sidewalls of the substantially rigid outer containers is partially open.

4. A flood control apparatus, comprising: a plurality of substantially rigid containers, each of the substantially rigid containers including at least a first movable steel housing which is constructed of steel and which is capable of being moved from location to location, of being anchored to the ground in a selected location, and of being attached to a second, adjacent movable steel housing by one or more fasteners, the first movable steel housing having a top portion and a bottom portion, the housing also having at least one reinforcing sidewall made of steel and operably connecting the top and bottom portions, the steel reinforcing sidewall having a corrugated cross-section, the reinforcing sidewall providing for the effective transmission of compressive forces between the top portion and the bottom portion, wherein the plurality of substantially rigid containers are positioned in a selected location on a substantially horizontal surface in or proximate a flood zone, the substantially rigid containers being placed end-to-end to form a barrier, the plurality of substantially rigid containers being positioned above the water level of the body of water.

5. A flood control apparatus, comprising:

(a) a housing with a top portion, a bottom portion and sidewalls;

(b) a swiveling end section adjacent to one of the sidewalls, the swiveling end section having a substantially flat outer surface; and (c) a hinge operably connecting the swiveling end section to the housing.

6. A flood control method, comprising the steps of:

(a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion, the containers being configured so that they can be stacked thereby forming a stack of containers, the stack of containers being able to withstand compressive forces; and (b) positioning the plurality of substantially rigid containers at a selected location proximate a body of water, at least some of the substantially rigid containers being positioned at the selected location in a substantially abutting relationship, to form a barrier, wherein the substantially rigid sidewalls include non-integral members for providing resistance to compressive forces between the top and bottom portions of the housing.

7. A flood control method, comprising the steps of:

(a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion, the containers being configured so that they can be stacked thereby forming a stack of containers, the stack of containers being able to withstand compressive forces; and (b) positioning the plurality of substantially rigid containers at a selected location proximate a body of water, at least some of the substantially rigid containers being positioned at the selected location in a substantially abutting relationship, to form a barrier, wherein at least some of the substantially rigid containers are transportable and include a housing constructed of steel, the housing being capable of being moved from location to location, of being anchored to the ground in a selected location, and of being attached to a second, adjacent steel housing by one or more fasteners, the first housing having a top portion and a bottom portion, the housing also having at least one reinforcing sidewall made of steel and operably connecting the top and bottom portions, the steel reinforcing sidewall having a corrugated cross-section.

8. A flood control method, comprising the steps of:

(a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion, the containers being configured so that they can be stacked thereby forming a stack of containers, the stack of containers being able to withstand compressive forces; and (b) positioning the plurality of substantially rigid containers at a selected location proximate a body of water, at least some of the substantially rigid containers being positioned at the selected location in a substantially abutting relationship, to form a barrier, additionally comprising the step of inserting a flexible container into at least one of the substantially rigid containers, then adding water to the inside of the flexible container.

9. The flood control method of claim 8, additionally comprising the step of removing the water from the flexible container.

10. A flood control method, comprising the steps of:

(a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion, the containers being configured so that they can be stacked thereby forming a stack of containers, the stack of containers being able to withstand compressive forces; and (b) positioning the plurality of substantially rigid containers at a selected location proximate a body of water, at least some of the substantially rigid containers being positioned at the selected location in a substantially abutting relationship, to form a barrier, wherein at least two of the substantially rigid containers are adjacent to one another, forming a gap between them, the method additionally comprising the step of sealing at least a portion of the gap to prevent water from flowing between the adjacent substantially rigid containers.

11. The flood control method of claim 10, wherein the step of sealing the gap includes applying a curable foam to the gap.

12. The flood control method of claim 10, wherein the step of sealing the gap includes applying a plastic sheet over the gap.

13. A flood control method. comprising the steps of:

(a) providing a first container and a flexible sheet, the first container having at least a top portion, a bottom portion, and four sidewalls, the flexible sheet being substantially impervious to water, and having at least one fixed edge, which is connected to the first container, and at least one free edge, which is unconnected to the first container;

(b) placing the first container adjacent a second container proximate a body of water that is susceptible to flooding by a rising water level, to form a barrier against the flooding, wherein a ground surface is located between the first and second containers and the body of water; and (c) disposing at least a portion of the free edge of the flexible sheet over at least a portion of the ground surface between the body of water and the barrier formed by the first and second containers, wherein an air space is formed between the first and second substantially rigid containers, and wherein at least a portion of the flexible sheet covers the air space.

14. A flood control method, comprising the steps of:

(a) providing a first container and a flexible sheet, the first container having at least a top portion, a bottom portion, and four sidewalls, the flexible sheet being substantially impervious to water, and having at least one fixed edge, which is connected to the first container, and at least one free edge, which is unconnected to the first container;

(b) placing the first container adjacent a second container proximate a body of water that is susceptible to flooding by a rising water level, to form a barrier against the flooding, wherein a ground surface is located between the first and second containers and the body of water; and (c) disposing at least a portion of the free edge of the flexible sheet over at least a portion of the ground surface between the body of water and the barrier formed by the first and second containers, wherein at least a portion of the free edge of the flexible sheet is weighted.

15. The flood control method of claim 14, wherein the weighted portion of the flexible sheet includes a metal bar.

16. A flood control method, comprising the steps of:

(a) providing a first container and a flexible sheet, the first container having at least a top portion, a bottom portion, and four sidewalls, the flexible sheet being substantially impervious to water, and having at least one fixed edge, which is connected to the first container, and at least one free edge, which unconnected to the first container;

(b) placing the first container adjacent a second container proximate a body of water that is susceptible to flooding by a rising water level, to form a barrier against the flooding, wherein a ground surface is located between the first and second containers and the body of water; and (c) disposing at least a portion of the free edge of the flexible sheet over at least a portion of the ground of the ground surface between the body of water and the barrier formed by the first and second containers, wherein at least a portion of the flexible sheet overlaps at least a portion of the second substantially rigid container.

17. A flood control method, comprising the steps of:

(a) providing a plurality of substantially rigid containers, at least one of the containers having a top portion, a bottom portion and substantially rigid sidewalls operably connecting the top and bottom portions, the sidewalls being configured to withstand compressive forces between the top portion and the bottom portion, the containers being configured so that they can be stacked thereby forming a stack of containers, the stack of containers being able to withstand compressive forces; and (b) positioning the plurality of substantially rigid containers at a selected location proximate a body of water, at least some of the substantially rigid containers being substantially rigid outer containers, the substantially rigid outer containers being positioned at the selected location in a substantially abutting relationship, to form a barrier, and wherein at least one of the sidewalls of the substantially rigid outer containers is partially open.

* * * * *